US005649615A

United States Patent [19]

Oberdorf

[11] Patent Number: 5,649,615

[45] Date of Patent: Jul. 22, 1997

[54] CONVEYOR FOR COMPRESSING CIGARETTE BLOCKS

[75] Inventor: Manfred Oberdorf, Gevelsberg, Germany

[73] Assignee: Maschinenfabrik Alfred Schmermund GmbH & Co., Gevelsberg, Germany

[21] Appl. No.: 543,059

[22] Filed: Oct. 13, 1995

[30] Foreign Application Priority Data

Oct. 14, 1994 [DE] Germany ..... 44 36 717.1

[51] Int. Cl.[6] ..... B65G 57/00

[52] U.S. Cl. ..... 198/418.3; 131/282; 198/476.1

[58] Field of Search ..... 198/418.3, 469.1, 198/474.1, 475.1, 476.1; 53/148, 149, 152; 131/282, 283

[56] References Cited

U.S. PATENT DOCUMENTS

| | | | |
|---|---|---|---|
| 1,539,745 | 5/1925 | Kerlin et al. . | |
| 3,517,477 | 6/1970 | Thornton | 198/475.1 X |
| 4,907,608 | 3/1990 | Focke et al. | 131/282 |
| 5,154,278 | 10/1992 | Deutsch | 198/476.1 X |
| 5,282,527 | 2/1994 | Etani et al. | 198/418.3 |

FOREIGN PATENT DOCUMENTS

| | | |
|---|---|---|
| 168758 A3 | 1/1986 | European Pat. Off. . |
| 1561963 | 4/1970 | Germany . |
| 3018895 | 11/1980 | Germany . |
| 3046063 | 6/1982 | Germany . |
| 3929979 | 3/1991 | Germany . |

*Primary Examiner*—James R Bidwell
*Attorney, Agent, or Firm*—Chilton, Alix & Van Kirk

[57] ABSTRACT

A conveyor for compressing cigarette blocks to an appropriate size for packaging having a plurality of open cell bodies, each body defining an open cell therein, for receiving cigarette blocks in a configuration corresponding to that of cigarettes in a cigarette pack. Each cell body is comprised of a single piece of sheet metal which has been bent into a generally U-shape and each cell body has first and second longitudinal walls, spaced at a distance corresponding to the height of the cigarette block to be received therein, and an end wall therebetween such that said longitudinal walls and said end wall cooperate to form the generally U-shaped body. The conveyor further including a plurality of closure elements, for selectively opening and closing the open end of the cell bodies.

20 Claims, 2 Drawing Sheets

CONVEYOR FOR COMPRESSING CIGARETTE BLOCKS

BACKGROUND OF THE INVENTION

1. Field of the Invention

The present invention relates to the packaging of cigarettes and more particularly to the compressing of cigarette blocks to the appropriate size for wrapping. More specifically, this invention is directed to a conveyor having a plurality of cell bodies for receiving cigarette blocks wherein each cell body has an open end which can be selectively closed with a closure element whereby the cigarette block is compressed in one direction. Accordingly, the general objects of the present invention are to provide novel and improved apparatus and methods of such a character.

2. Description of the Prior Art

The use of automated machinery for manufacturing and subsequently packaging cigarettes is widespread. Typically, cigarettes are formed on a manufacturing line where a number of machines each perform a specific function and then transfer the cigarettes to the next machine for additional processing. Several of the processing steps which must be performed prior to packaging cigarettes using conventional machinery typically include (1) arranging a number of individual cigarettes into a "block" having a shape which corresponds to the desired configuration of the final package; (2) compressing the cigarette block along the height of the block; (3) compressing the cigarette block along the width of the block; and (4) conveying the cigarette block into and out of the various machines during processing. Since packages of cigarettes must be produced in enormous volume at the lowest possible price, all of these steps must be accurately performed at a very high rate of speed. Thus, eliminating one or more of the above-mentioned steps and/or minimizing the time required for performing any one or more of these steps can greatly improve the efficiency of the overall process. Accordingly, reducing the complexity of either the machinery or the number of steps required for compression of a cigarette block is highly desirable.

Apparatus for conveying and compressing cigarette blocks are well known in the art. For example, German Patent DE-C-3 046 063 discloses the use of a cigarette block turret having a number of cell bodies which receive cigarette blocks and subsequently conveys them to a separate pressing turret. After the cigarette blocks have been transferred from the cells of the block turret to the pressing turret, they are compressed into the appropriate size for packaging. To improve the speed of the process, the cigarette blocks are transferred from the block turret to the pressing turret in pairs using a double slide structure. Additionally, the pressing turret receives the cigarette blocks in cells which are also arranged in pairs. When the cells of the pressing turret are in a subsequent transfer position they are radially inclined towards one another so that the cigarette blocks may exit the cells of the pressing turret and enter adjacent cells of a larger surrounding turret. Thus, as disclosed in German Patent DE-C-3 046 063, the cigarette block compression procedure requires separate machinery for performing the distinct steps of conveying and compressing.

German Patent DE-A-3 929 979 discloses a device for arranging a number of individual cigarettes into a cigarette block and compressing that cigarette block along the height of the block. The device of this patent has a conveyor which runs along a cigarette funnel with a number of receiving pockets. The receiving pockets are partitioned at the entry region of the funnel and converge toward an outlet side so that each cigarette block is compressed along the height of the block. Thus, as each cigarette blocks exits this device, it is compressed along the height of the block to the desired size, but is not yet compressed along the width of the block. Accordingly, an additional step to compress each cigarette block along the width of the block is required prior to packaging.

Finally, another device for conveying and compressing cigarette blocks is disclosed in German Patent DE-A-1 561 963. This device has a conveyor with a number of open cell bodies for compressing cigarette blocks to the desired size wherein all of the parts of each cell body, except for a base plate, move relative to one another to compress a cigarette block. While this device does compress cigarette blocks as intended, the relatively large number of moving parts in this design increases the overall weight, cost and complexity of the system and reduces the efficiency of the design. Additionally, the required use of relatively heavy plates in the cell bodies themselves effectively precludes the possibility of using this device at the high operating speeds normally expected in the cigarette packaging field.

In short, there exists a need for an apparatus which will simplify the cigarette block compression procedure whereby compression along the width of the cigarette block can occur at high operating speeds, thereby resulting in an increase in cigarette production efficiency.

SUMMARY OF THE INVENTION

It is accordingly an object of the present invention to provide a cigarette block conveyor having a number of turrets for both conveying and compressing cigarette blocks along the width of each block in a single step and at high operating speeds.

This and other objects and advantages of the present invention are provided in one embodiment by forming a conveyor having a plurality of turrets with open-ended block receiving cells which are each comprised of a single piece of material which has been formed into a generally U-shaped body. Each cell body has first and second longitudinal walls spaced at a distance which corresponds to the height of the cigarette block to be received therein and one end wall therebetween. Each cell body has one end which can be selectively opened and closed. When a cigarette block is received within a cell body and a closure element closes the open end of the cell body, the cigarette block will be compressed along the width of the block by the closure element. The closure element can then be retracted to, once again, open the open end of the cell body and the cigarette block can be transferred to another device for further processing.

The present invention offers improved performance relative to the prior art devices briefly described above. Since each cell body of apparatus in accordance with the present invention is formed of a single piece of comparatively light-weight material which has been bent into a generally U-shape, the present invention offers a more simplified design than that of the prior art. Forming cell bodies in this manner reduces the number of parts which comprise the compression apparatus and thereby reduces the amount of related machinery (e.g. screws and/or devices to drive moving parts). This weight reduction relative to the prior art allows the conveyor to operate at high operating speeds. The present invention further enhances operational speed by enabling the steps of conveying and compression to be performed simultaneously. Thus, whereas prior art devices customarily required separate steps for conveying the cigarette block to a compressing station, and thereafter compressing the cigarette block, the present invention performs these steps simultaneously. Again, this results in increased operating speeds, an overall weight reduction and lower costs.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE PREFERRED EMBODIMENTS

Figure 1:
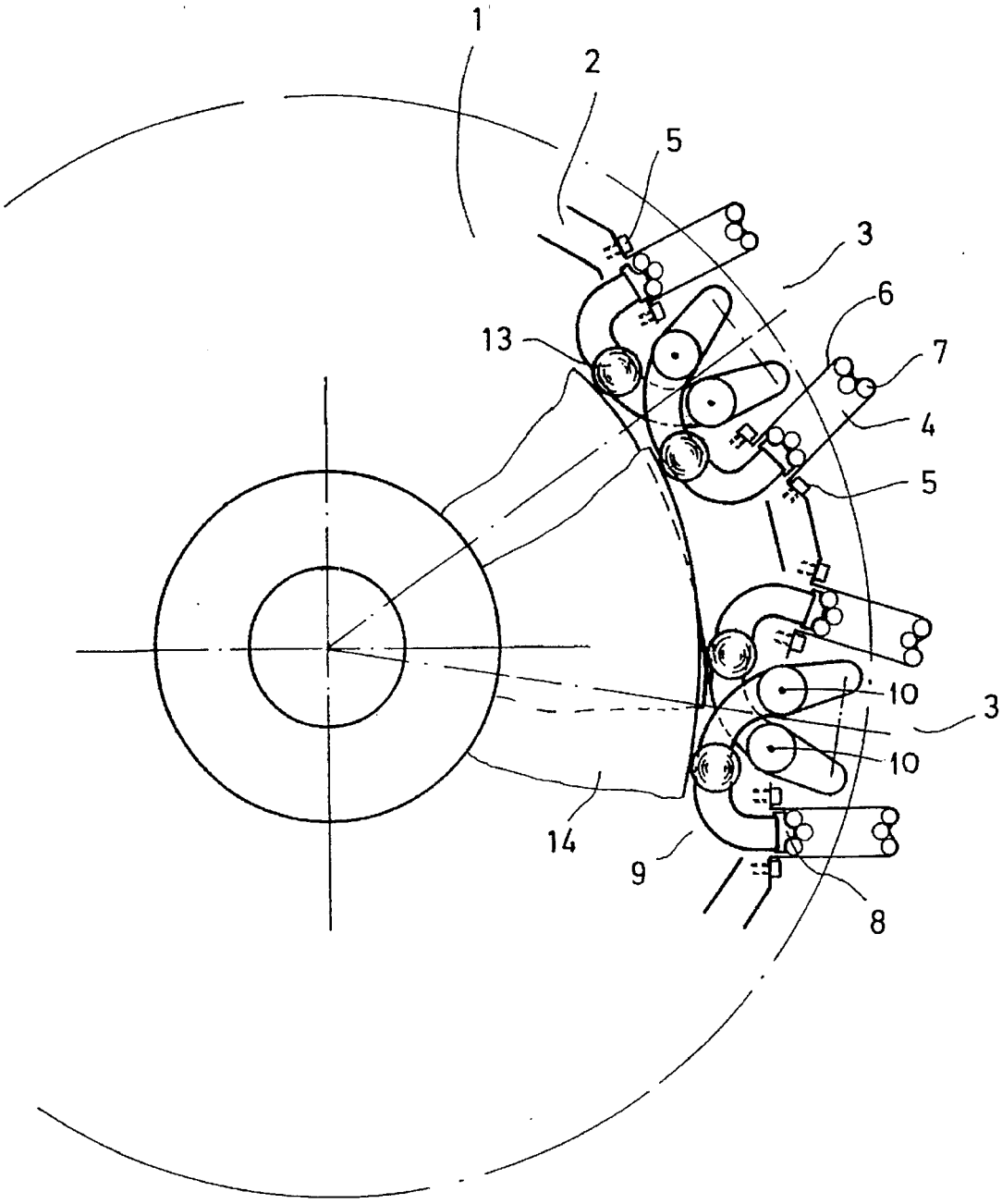
FIG. 1 shows a partial schematic view of one embodiment of a conveyor in accordance with the present invention.

FIG. 1 shows a portion of a conveyor in accordance with one embodiment of the present invention. The conveyor of FIG. 1 has a turret disk 1, which generally functions as a movable base, and a number of cell supports 2 which are mounted at regular intervals near the circumference of turret disk 1. Cell supports 2 fixedly support a cell body 6, at each end thereof such that each passage opening 3 is at least partially congruent with an open cell 4 by defined cell body 6. The longitudinal walls of cell body 6 are attached to cell supports 2, adjacent to passage openings 3, by means of screws 5. The cell bodies 6 are mounted on cell supports 2 such that the open end thereof generally face toward the center of turret disk 1. It will be readily appreciated by those of ordinary skill in the art that the preferred embodiment employs a plurality of structures, which are substantially similar to those described above, extending around turret disk 1.

As shown in FIG. 1, the preferred embodiment of the present invention employs a plurality of cell bodies 6 which are arranged in pairs and radially inclined towards one another. When the conveyor is in a transfer position, each pair of cell bodies 6 become aligned with a pair of corresponding radially inclined cells of a larger surrounding turret so that initial reception of cigarette blocks into the conveyor and subsequent transfer therefrom to the surrounding turret can occur in pairs.

Cell bodies 6 are preferably formed by bending a single thin sheet of metal into a generally U-shaped configuration. Each U-shaped cell body 6 consists of substantially parallel first and second longitudinal walls which are spaced at a distance corresponding to the height of the cigarette block to be received therein. Each cell body 6 also has an end wall connecting the first and second longitudinal walls at one end to form the bottom of the U. The end wall preferably has an inwardly extending region, located approximately halfway between the first and second longitudinal walls, which projects into cell 4 a distance of about half of the diameter of a cigarette. Since cigarette blocks are typically formed by arranging twenty individual cigarettes into a block having three rows (a row of six sandwiched between two rows of seven) the inwardly projecting region of the end wall generally conforms to the shape of the block in the region of the shorter central row of cigarettes. Finally, the free ends of the first and second longitudinal walls are preferably turned outward so that each cell body 6 is adapted to be mounted onto a cell support. 2 with the above-mentioned screws 5.

Figure 2:
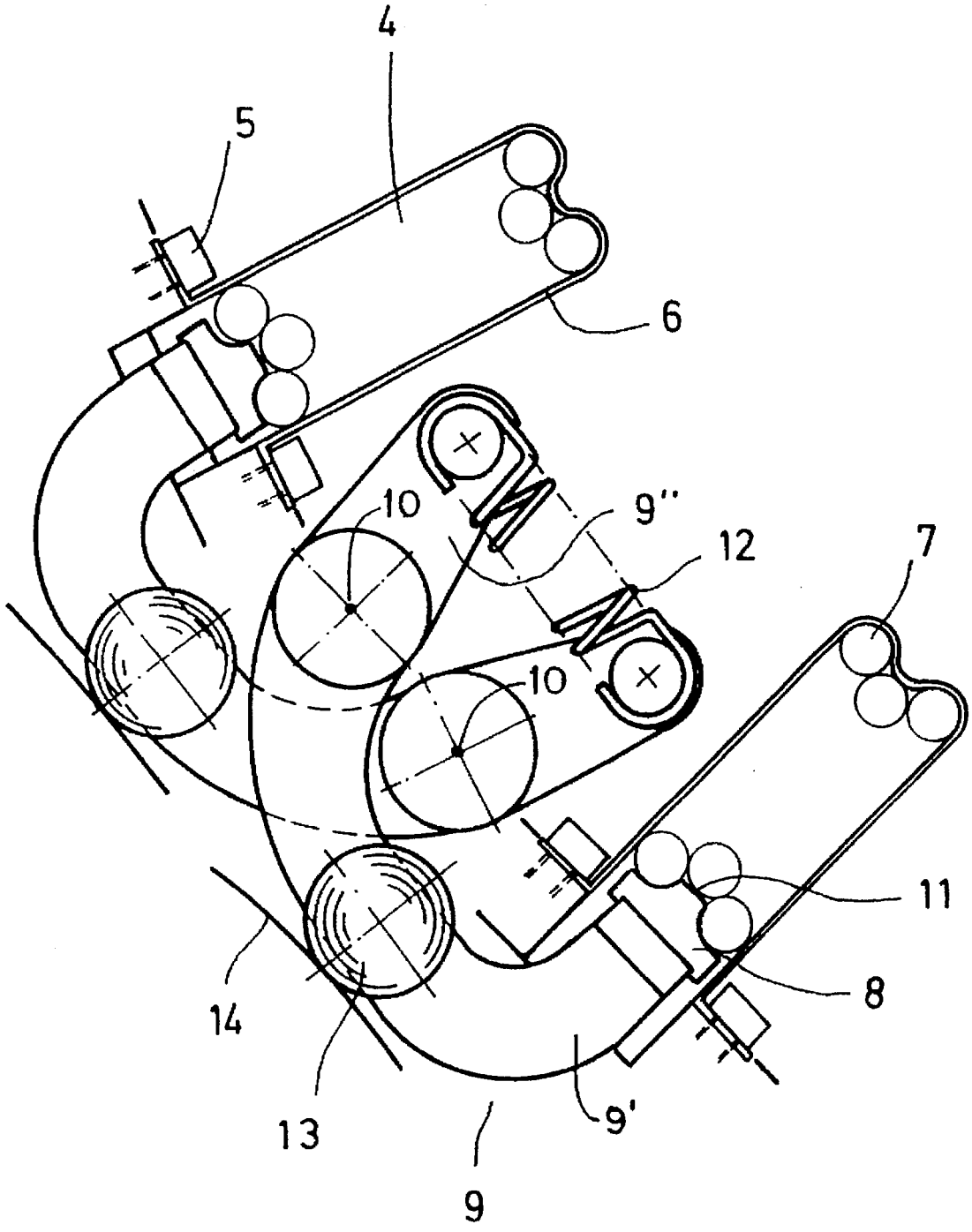
FIG. 2 shows an enlarged view of one of the turrets of the conveyor shown in FIG. 1.

Referring now to FIG. 2, in the preferred embodiment generally U-shaped double levers 9 are pivotally mounted on turret disk 1 for rotation about parallel axes 10. An arm 9' of each double lever 9 extends through a passage opening 3 defined by a cell support 2 toward the open end of cell body 6. Closure elements 8 are mounted on the ends of the arms 9' of the double levers 9. A second arm 9" of each double lever 9 extends from the pivot axis 10 of the lever in a direction opposite to that of arm 9'. A spring 12 is connected from arm 9" of a first double lever 9 to a corresponding arm of an identical adjacent double lever. Accordingly, the arms 9' of a pair of adjacent double levers 9 are spring biased into associated cells 4 of open ended cell bodies 6.

Referring again to FIG. 2, arm 9' of each double lever 9 carries a cam follower 13 which is operably associated with a fixed cam 14. Cam followers 13 can be either rollers or a low friction surface or any equivalent thereof. Turret disk 1 rotates independently of fixed cams 14. Upon rotation of turret disk 1, cam followers 13 are guided along the edge of fixed cams 14 causing double levers 9 to pivot about their pivot axes 10 thereby inducing corresponding movement of closure elements 8. Thus, when turret disk 1 is rotated, closure elements 8 selectively pass through passage openings 3 to open and close the open ends of cell bodies 6 and upon closure of the open end of a cell body 6, a closure element 8 extends into the cell 4.

As shown in FIG. 1 and 2, double levers 9 are arranged in overlapping pairs, i.e., adjacent double levers 9 are symmetric relative to one another about a line which extends from the center of turret disk 1 between adjacent cell supports 2. While FIG. 2 shows arm 9" of a double lever 9 connected to a corresponding arm of an adjacent double lever with a spring 12, an alternative embodiment employs two separate springs wherein one spring biases arm 9" and the other spring independently biases the corresponding arm on the adjacent double lever. The fixed cams 14 are arranged to cause the adjacent double levers 9 to pivot about their respective pivot axes in opposite directions. Providing for pivoting in opposite directions in this manner results in coordinated opening and closing of adjacent cell bodies by their respective closure elements 8. Since double levers 9 are arranged in overlapping pairs, the associated cam followers 13 are located at different levels and the cams 14 can, thus, be at correspondingly different levels also.

When a conveyor of the present invention is in an initial transfer position, cigarette blocks of the type described above (i.e., a block which has already been compressed along the height dimension) are transferred into cells 4 by another conveyor or any equivalent means such as a cigarette funnel. In this initial transfer position of the apparatus, each arm 9' of each double lever 9 has been retracted relative to the associated cell body 6 as a result of cam follower 13 following the edge of its associated cam 14. In this transfer position, each arm 9" has been rotated against the force of compression spring 12 and closure element 8 has been retracted from cell body 6. Accordingly, cell body 6 is open and is, thus, capable of receiving a cigarette block with an uncompressed width. Upon rotation of turret disk 1, closure element 8 moves into cell body 6 under the influence of expanding spring 12. Closure element 8 thus compresses the width of the cigarette block located therein to the desired width. Further, rotation of turret disk 1 causes arm 9' to again be retracted from cell body 6, i.e., the double lever 9 returns to the initial transfer position, thereby completing the cycle, so that the compressed cigarette block can be transferred out of the cell for further processing. It will readily appreciated by those of ordinary skill in the art that the numerous turrets, cells, etc. located around turret disk 1 also simultaneously operate in a substantially similar manner.

A wide variety of modifications may be made to the embodiment described above. For example, in an alternative embodiment, the interaction between arm 9" (as a result of the interaction of double lever 9, cam follower 13, and cam 14) and spring 12 is reversed. Thus, in this embodiment, spring 12 urges closure element 8 away from cell body 6 and cam 14 urges closure element 8 toward cell body 6. In another alternative embodiment, the use of a double groove for cam 14 eliminates the need to spring bias lever 9 and also eliminates the need for lever 9 to be a double lever. In yet another embodiment lever 9 can also act radially from the outside to the inside of cell 4 which is then closed radially on the inside end.

In yet another embodiment, the means for selectively opening and closing the open end of each cell body consists of a closure element mounted on one end of a ram which moves linearly in a direction generally parallel to first and second longitudinal walls of each cell body.

In still another alternative embodiment, the cell bodies, double levers and springs can be mounted on a circulating conveyor belt or other movable base, instead of turret disk 1, which moves relative to one or more fixed cams. The relative motion between the fixed cams and the elements on the circulating conveyor belt impart motion in a manner similar to that described above. Furthermore, movement of the various parts such as arms 9 etc. can also be imparted by the cooperation between a fixed base and one or more movable cams. However, regardless of whether a turret disk or a belt conveyor is employed, the motion imparted to the other components can be in the nature of either discrete steps or continuous movement.

While a preferred embodiment and number of alternatives thereto have been shown and described, it will be appreciated that various other modifications and substitutions may be made without departing from the spirit and scope of the invention. Accordingly, it is to be understood that the present invention has been described by way of illustration and not limitation.

What is claimed is:

1. A conveyor for compressing cigarette blocks in at least a first dimension, wherein each cigarette block has a generally rectangular shape with a width and a height and consists of a plurality of cigarettes arranged in a manner corresponding to the arrangement desired after packaging, said apparatus comprising:

(a) movable base means;

(b) a plurality of open-ended cell bodies for receiving the cigarette blocks, each of said cell bodies being comprised of a single piece of material and including substantially parallel first and second longitudinal walls, said walls being spaced at a distance corresponding to a first dimension of the cigarette block to be received therein, and an end wall therebetween such that said longitudinal walls and said end wall cooperate to form a generally U-shaped body having an open cell therein;

(c) mounting means for fixedly mounting each of said open-ended cell bodies to said movable base means;

d) a plurality of closure elements, for selectively opening and closing the open end of an associated one of said open-ended cell bodies, said closure elements being movably mounted on said movable base means and being sized and shaped such that each of said closure elements is capable of being received within one of said cell bodies whereby a cigarette block received within one of said cell bodies is compressed in the second dimension of the cigarette block when said closure element is moved into said cell body; and (e) means for moving said closure elements into or out of said cell bodies when said movable base means moves.

2. A conveyor as recited in claim 1, wherein said mounting means comprises a plurality of cell body supports, wherein each of said supports includes means defining at least one opening through which one of said closure elements may pass into one of said cell bodies, and wherein said longitudinal walls of each of said cell bodies are attached to said supports adjacent to said opening.

3. A conveyor as recited in claim 1, wherein said means for moving said closure elements comprises at least one lever pivotably mounted on said movable base means, wherein each of said levers has a cam follower, and wherein said conveyor further comprises at least one cam for imparting motion to said cam follower of each of said levers as said movable base means is moved.

4. A conveyor as recited in claim 3, wherein each of said levers is a generally U-shaped double lever.

5. A conveyor as recited in claim 4, wherein said U-shaped levers are arranged in symmetrically overlapping pairs.

6. A conveyor as recited in claim 4, further comprising resilient means for biasing said levers to an initial position.

7. A conveyor as recited in claim 5, wherein said resilient means is connected between said overlapping pairs of levers.

8. A conveyor as recited in claim 6, wherein said U-shaped levers are arranged in symmetrically overlapping pairs.

9. A conveyor as recited in claim 8, wherein said resilient means is connected between said overlapping pairs of levers.

10. A conveyor as recited in claim 9, wherein said mounting means comprises a plurality of cell body supports, wherein each of said supports includes means defining at least one opening through which one of said closure elements may pass into one of said cell bodies, and wherein said longitudinal walls of each of said cell bodies are attached to said supports adjacent to said opening.

11. A conveyor as recited in claim 8, wherein said mounting means comprises a plurality of cell body supports, wherein each of said supports includes means defining at least one opening through which one of said closure elements may pass into one of said cell bodies, and wherein said longitudinal walls of each of said cell bodies are attached to said supports adjacent to said opening.

12. A conveyor as recited in claim 6, wherein each of said closure elements is received within one of said cell bodies when said levers are in said initial position.

13. A conveyor as recited in claim 4, wherein said mounting means comprises a plurality of cell body supports, wherein each of said supports includes means defining at least one opening through which one of said closure elements may pass into one of said cell bodies, and wherein said longitudinal walls of each of said cell bodies are attached to said supports adjacent to said opening.

14. A conveyor as recited in claim 3, further comprising resilient means for biasing said levers to an initial position.

15. A conveyor as recited in claim 14, wherein each of said levers is a generally U-shaped double lever, and wherein said U-shaped levers are arranged in symmetrically overlapping pairs.

16. A conveyor as recited in claim 15, wherein said resilient means is connected between said overlapping pairs of levers.

17. A conveyor as recited in claim 16, wherein each of said closure elements is received within one of said cell bodies when said levers are in said initial position.

18. A conveyor as recited in claim 8, wherein each of said closure elements is received within one of said cell bodies when said levers are in said initial position.

19. A conveyor as recited in claim 18, wherein said resilient means is connected between said overlapping pairs of levers.

20. A conveyor as recited in claim 19, wherein said mounting means comprises a plurality of cell body supports, wherein each of said supports includes means defining at least one opening through which one of said closure elements may pass into one of said cell bodies, and wherein said longitudinal walls of each of said cell bodies are attached to said supports adjacent to said opening.

* * * * *